US007413472B2

(12) United States Patent
Iijima

(10) Patent No.: US 7,413,472 B2
(45) Date of Patent: Aug. 19, 2008

(54) ELECTRONIC APPARATUS INCLUDING ENCLOSURE HAVING OPENING FOR CONNECTOR

(75) Inventor: Takashi Iijima, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/703,222

(22) Filed: Feb. 7, 2007

(65) Prior Publication Data

US 2008/0064257 A1 Mar. 13, 2008

(30) Foreign Application Priority Data

Sep. 12, 2006 (JP) ..... 2006-247277

(51) Int. Cl.
*H01R 13/60* (2006.01)

(52) U.S. Cl. ..... 439/535; 174/59

(58) Field of Classification Search ..... 439/535, 439/536, 544, 571; 174/59

See application file for complete search history.

(56) References Cited

U.S. PATENT DOCUMENTS 5,738,539 A * 4/1998 Caveney et al. ..... 439/535

FOREIGN PATENT DOCUMENTS

| | | |
|---|---|---|
| JP | 5-275868 | 10/1993 |
| JP | 6-326479 | 11/1994 |

* cited by examiner

*Primary Examiner*—Ross N Gushi
(74) *Attorney, Agent, or Firm*—Staas & Halsey LLP

(57) ABSTRACT

A wall stands upright from the surface of the bottom plate in the vertical direction in an electronic apparatus. An opening is defined in the wall. A connector defines a cylindrical portion located in the opening to receive a plug. A rib stands upright from the surface of the bottom plate. The rib defines a lock surface and an inclined surface. The lock surface extends in the vertical direction so as to hold the connector between the wall and the lock surface itself. The inclined surface is connected to the upper end of the lock surface. When the connector is set within the enclosure, the connector is received on the inclined surface. The connector slides on the inclined surface. The cylindrical portion enters the opening. When the connector drops off the inclined surface, the connector is fitted between the lock surface and the wall.

2 Claims, 5 Drawing Sheets

ELECTRONIC APPARATUS INCLUDING ENCLOSURE HAVING OPENING FOR CONNECTOR

BACKGROUND OF THE INVENTION

1. Field of the Invention

The present invention relates to an electronic apparatus such as a notebook personal computer. In particular, the present invention relates to an electronic apparatus including an enclosure defining an opening and a connector defining a cylindrical portion located in the opening to receive a plug.

2. Description of the Prior Art

An AC (alternating current) adapter is utilized for a notebook personal computer for supplying electric power, for example. A supply connector is mounted on the notebook personal computer for connection of the AC adapter. The supply connector defines a cylindrical portion to receive a plug. The cylindrical portion of the supply connector is located in an opening defined in the enclosure of the notebook personal computer.

The enclosure of the notebook personal computer includes abase. A cover is coupled to the base. A motherboard and other electronic components are placed within the inner space defined between the base and the cover. A recess is formed in the surrounding wall of the base. The cover is coupled to the surrounding wall of the base so as to define the aforementioned opening in cooperation with the recess. The cover serves to hold the cylindrical portion of the supply connector within the recess.

When the notebook personal computer is to be assembled, the cylindrical portion of the supply connector is first simply placed in the recess. The wiring of the supply connector is then connected to the motherboard, for example. The elasticity of the wiring often causes detachment of the supply connector from the recess. The supply connector needs to be held in the recess until the cover is completely coupled to the base. This leads to a troublesome assembling operation.

SUMMARY OF THE INVENTION

It is accordingly an object of the present invention to provide an enclosure and an electronic apparatus and a method of making the same, contributing to a simplified assembling operation.

According to a first aspect of the present invention, there is provided an electronic apparatus comprising: an enclosure defining a wall standing upright from the surface of the bottom plate in the vertical direction; an opening defined in the wall; a connector defining a cylindrical portion located in the opening to receive a plug; and a rib standing upright from the surface of the bottom plate, the rib defining a lock surface and an inclined surface, the lock surface extending in the vertical direction so as to hold the connector between the wall and the lock surface itself, the inclined surface being connected to the upper end of the lock surface, the inclined surface getting farther from the surface of the bottom plate at a position farther from the opening.

When the connector is set within the enclosure, the connector is received on the inclined surface of the rib. The connector is allowed to slide on the inclined surface. The connector gets closer to the bottom plate of the enclosure at a position closer to the opening of the wall. In this case, the cylindrical portion of the connector is allowed to enter the opening. When the connector drops off the inclined surface toward the bottom plate, the connector is fitted between the lock surface of the rib and the wall. The cylindrical portion is kept in the opening. The connector is in this manner assembled into the enclosure.

The connector is held between the rib and the wall in the electronic apparatus of this type. The cylindrical portion is received in the opening to engage with the wall for keeping the connector between the rib and the wall. The connector is in this manner engaged with the enclosure. The connector is reliably prevented from detachment from the enclosure during the assembling of the electronic apparatus. This results in a simplified assembling operation of the electronic apparatus.

The plug is pushed into the cylindrical portion of the connector when the plug is to be coupled to the connector, for example. The connector thus suffers from an urging force in the inward direction of the enclosure. In this case, the lock surface receives the connector. The lock surface bears the urging force. The lock surface serves to reliably prevent the connector from movement in the inward direction of the enclosure.

According to a second aspect of the present invention, there is provided an enclosure comprising: a bottom plate; a wall standing upright from the surface of the bottom plate in the vertical direction, the wall defining an opening; and a rib standing upright from the surface of the bottom plate, the rib defining a lock surface and an inclined surface, the lock surface standing upright from the surface of the bottom plate in the vertical direction so as to define a rectangular parallelepiped space between the wall and the lock surface itself, the inclined surface being connected to the upper end of the lock surface, the inclined surface getting farther from the surface of the bottom plate at a position farther from the opening.

The enclosure greatly contributes to realization of the aforementioned electronic apparatus. A cylindrical portion of the connector can be received in the opening, for example. In this case, the connector is positioned in the rectangular parallelepiped space between the lock surface of the rib and the wall. The connector is thus engaged with the enclosure. The connector is in this manner reliably prevented from detachment from the enclosure during the assembling of the electronic apparatus. This results in a simplified assembling operation of the electronic apparatus.

According to a third aspect of the present invention, there is provided a method of making an electronic apparatus, comprising: sliding a connector along an inclined surface defined on a rib distanced from a wall standing upright from the bottom plate in the vertical direction, the inclined surface getting closer to the bottom plate at a position closer to the wall; inserting a cylindrical portion of the connector into an opening defined in the wall through sliding movement of the connector along the inclined surface; and getting the connector of f the inclined surface toward the bottom plate after insertion of the cylindrical portion so that the connector is interposed between the wall and a lock surface connected to the front end of the inclined surface, the lock surface extending in the vertical direction at a position distanced from the wall.

The cylindrical portion of the connector is received in the opening while the connector is held between the lock surface of the rib and the wall. The connector is in this manner engaged with the enclosure. The connector is thus prevented from detachment from the enclosure during the assembling of the electronic apparatus. This results in a simplified assembling operation of the electronic apparatus.

BRIEF DESCRIPTION OF THE DRAWINGS

The above and other objects, features and advantages of the present invention will become apparent from the following description of the preferred embodiment in conjunction with the accompanying drawings, wherein.

DESCRIPTION OF THE PREFERRED EMBODIMENT

Figure 1:
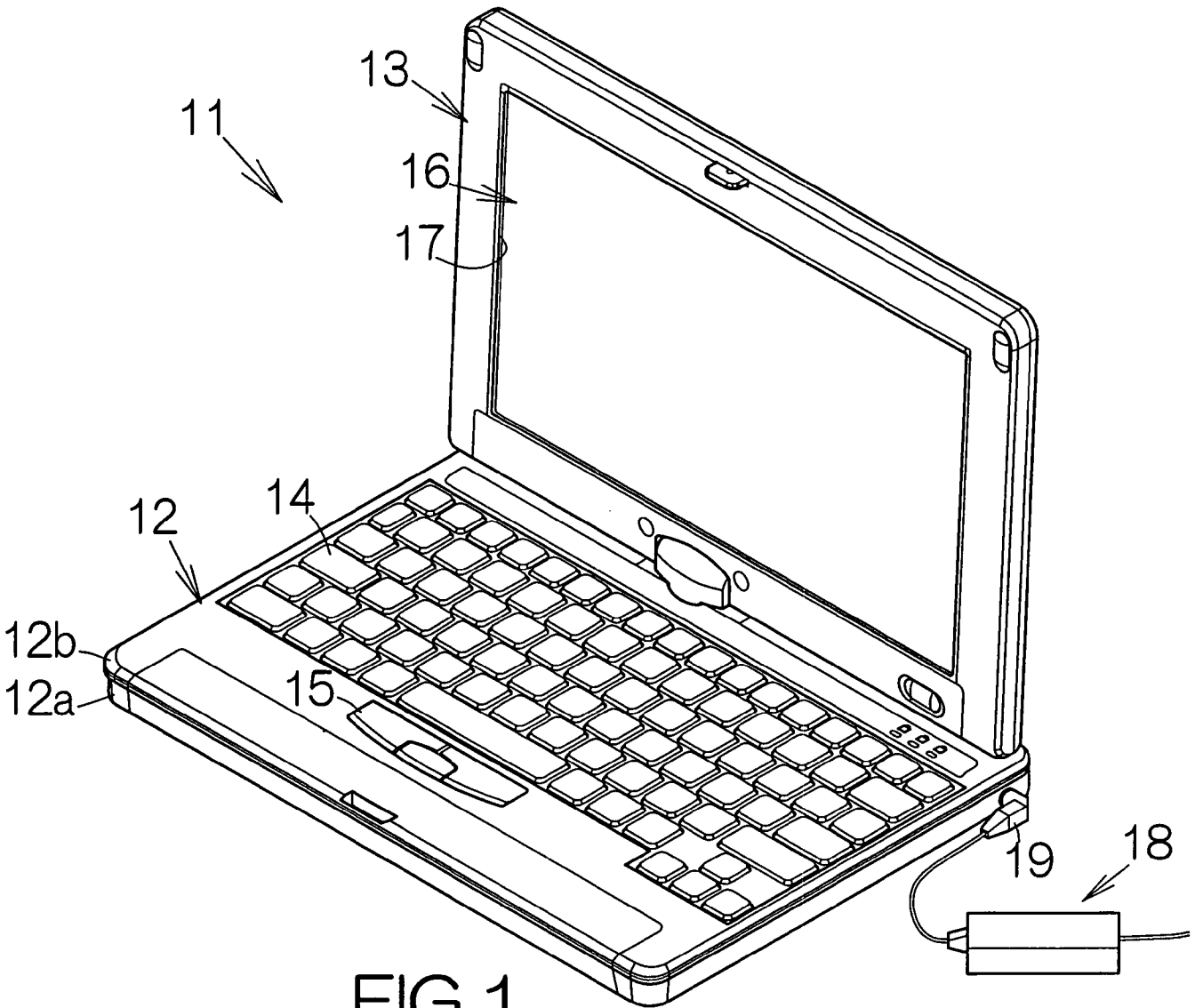
FIG. 1 is a perspective view schematically illustrating a notebook personal computer as a specific example of an electronic apparatus according to the present invention.

FIG. 1 schematically illustrates a notebook personal computer 11 as a specific example of an electronic apparatus according to the present invention. The notebook personal computer 11 includes a thin first enclosure, namely a main body enclosure 12, and a second enclosure, namely a display enclosure 13. The display enclosure 13 is coupled to the main body enclosure 12 for a relative swinging movement. The main body enclosure 12 includes a base 12*a* and a cover 12*b* removably coupled to the base 12*a*. Input devices such as a keyboard 14 and a pointing device 15 are embedded in the front surface of the main body enclosure 12. Users are invited to manipulate the keyboard 14 and/or the pointing device 15 to input commands and/or data.

A liquid crystal display (LCD) panel module 16 is enclosed in the display enclosure 13, for example. The screen of the LCD panel module 16 is exposed in a window opening 17 defined in the display enclosure 13. Texts and graphics are displayed on the screen. Users can see the ongoing operation of the notebook personal computer 11 based on the displayed texts and graphics. The display enclosure 13 can be superimposed on the main body enclosure 12 through the pivotal movement relative to the main body enclosure 12.

An AC (alternating current) adapter 18 has a plug 19 coupled to the main body enclosure 12. The plug 19 has the structure of a male connector, for example. The AC adapter 18 is supplied with the alternating current from an outlet, not shown, for example. The AC adapter 18 enables conversion from the alternating current to the direct current. The converted direct current is supplied to the notebook personal computer 11 through the plug 19.

Figure 2:
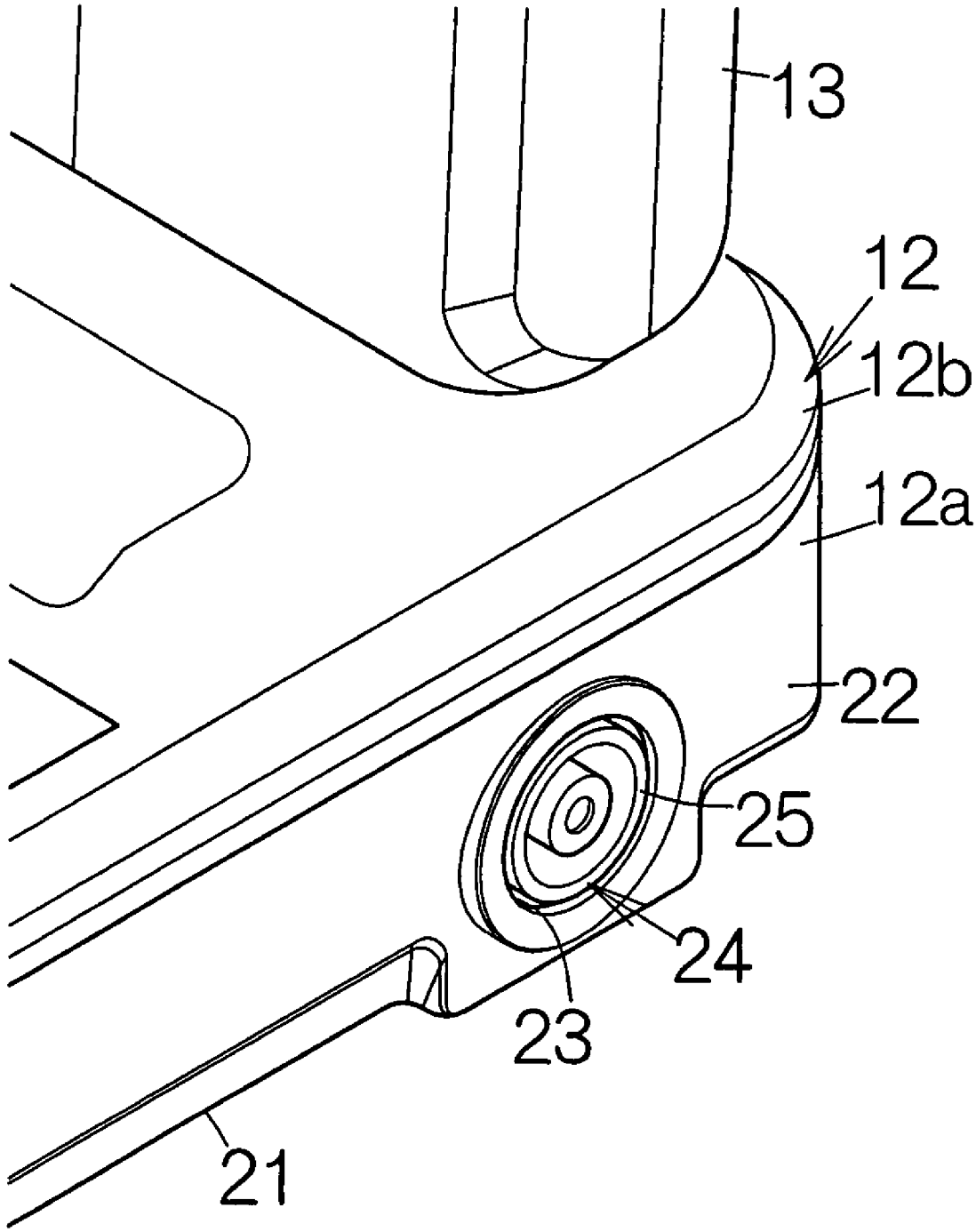
FIG. 2 is an enlarged partial perspective view schematically illustrating a cylindrical portion located in an opening defined in an enclosure.

As shown in FIG. 2, the base 12*a* includes a bottom plate 21 and a wall 22 standing upright from the surface of the bottom plate 21 in the vertical direction. A circular opening 23 is defined in the wall 22. The opening 23 defines a disk-shaped inner space, for example. A supply connector 24 is enclosed in the main body enclosure 12. The supply connector 24 defines a cylindrical portion 25 received in the opening 23. The front end of the cylindrical portion 25 is in this manner positioned within the opening 23. The supply connector 24 is designed to receive the plug 19 at the cylindrical portion 25. The supply connector 24 has the structure of a female connector, for example.

Figure 3:
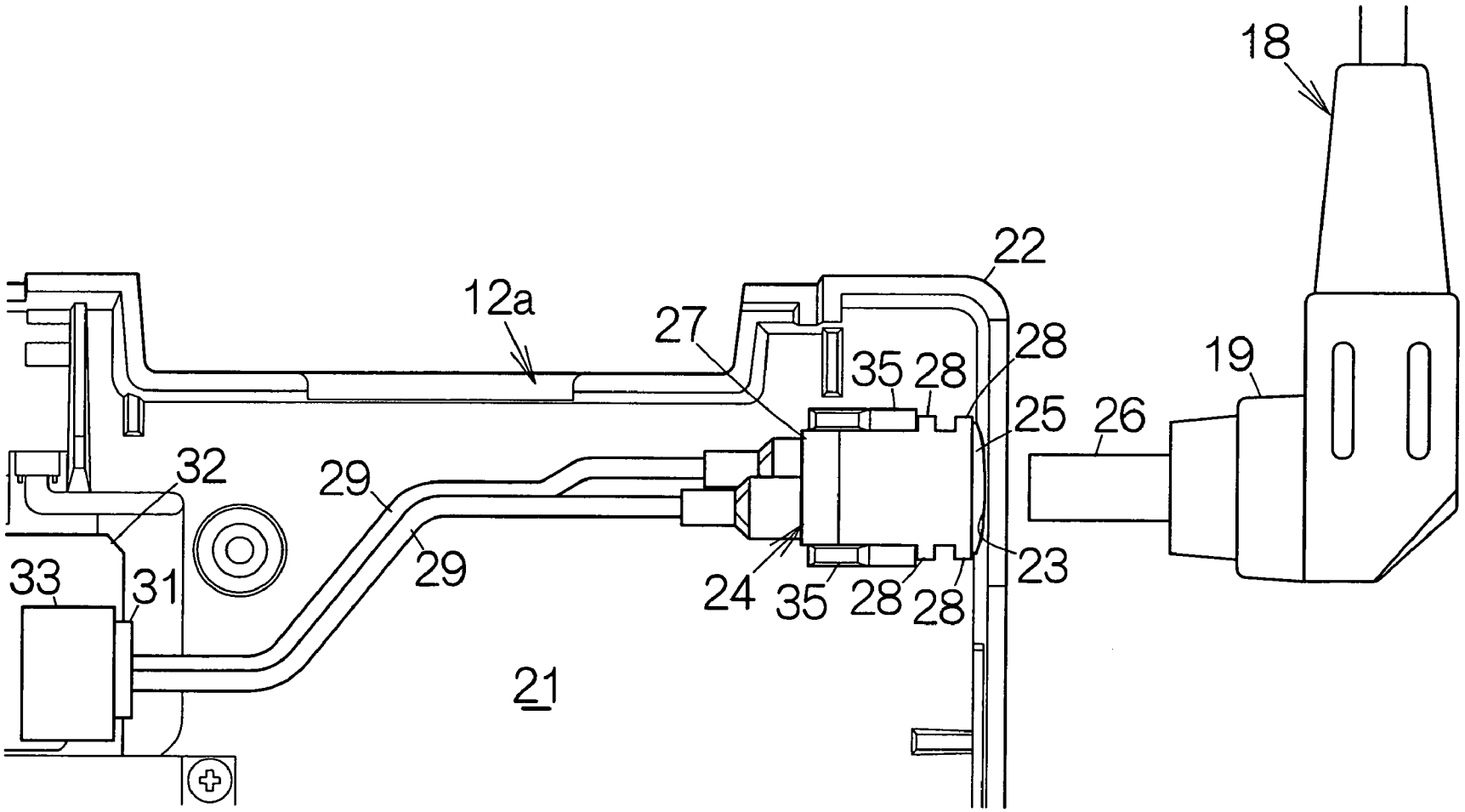
FIG. 3 is an enlarged partial plan view schematically illustrating a supply connector.

As shown in FIG. 3, the cylindrical portion 25 of the supply connector 24 receives a cylindrical portion 26 of the plug 19. The supply connector 24 includes a main body 27 made of a resin material, for example. The main body 27 has the front end defining the cylindrical portion 25. The main body 27 is formed in the shape of a rectangular parallelepiped, for example. Front and rear pairs of protuberances 28, 28 are formed to protrude outward from the side surfaces of the main body 17. The front and rear protuberances 28 may extend in parallel with each other on the side surface. The front and rear protuberances 28 are designed to extend in the direction vertical to the bottom plate 21 of the base 12*a*.

Ends of wirings 29, 29 are attached to the main body 27, for example. The other ends of the wirings 29, 29 are attached to a male connector 31. The male connector 31 is coupled to a female connector 33 on a printed circuit board 32 enclosed in the main body enclosure 12. When the plug 19 is electrically connected to the supply connector 24, electric power is supplied from the outlet to electronic components, a central processing unit (CPU) and a memory on the printed circuit board 32.

Figure 4:
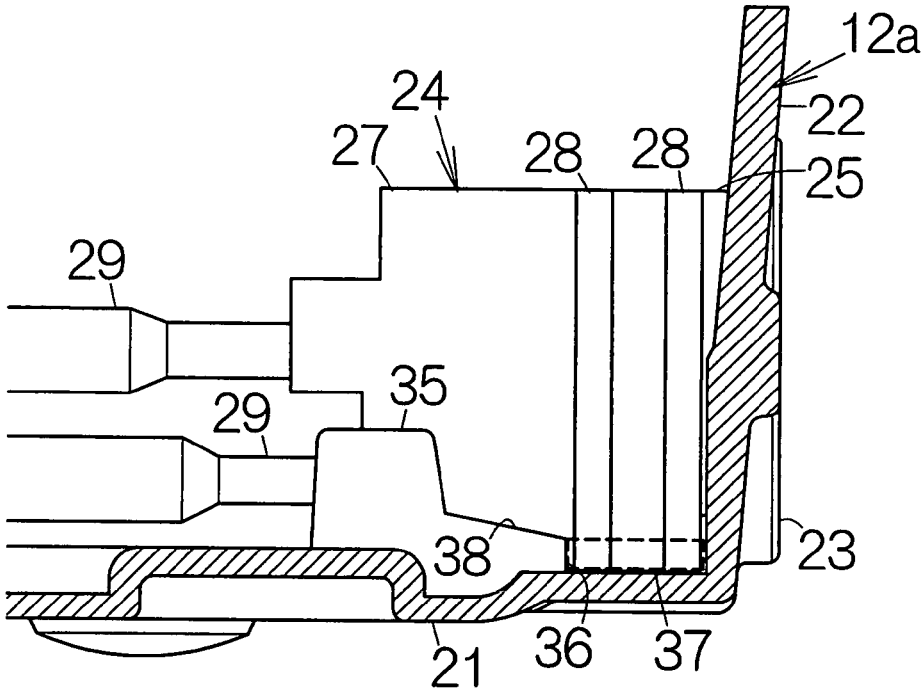
FIG. 4 is an enlarged partial sectional view schematically illustrating the relationship between the supply connector and a rib.

A pair of ribs 35, 35 are defined in the bottom plate 21 of the base 12*a*. The ribs 35 stand upright from the surface of the bottom plate 21. The main body 27 is held between the ribs 35 at a position behind the protuberances 28. As shown in FIG. 4, the individual rib 35 defines a flat lock surface 36 standing upright from the surface of the bottom plate 21 in the vertical direction. A rectangular parallelepiped space 37 is defined between the individual lock surface 36 and the wall 22. The front and rear protuberances 28, 28 of the main body 27 are received in the corresponding rectangular parallelepiped space 37.

When the plug 19 is connected to the supply connector 24, for example, the cylindrical portion 26 of the plug 19 is pushed into the cylindrical portion 25 of the supply connector 24. The supply connector 24 thus receives an urging force in the inward direction of the main body enclosure 12. The lock surfaces 36 receive the corresponding rear protuberances 28. The lock surfaces 36 in this manner receive the urging force. The lock surfaces 36 prevent the supply connector 24 from moving inward into the main body enclosure 12.

The individual rib 35 defines a flat inclined surface 38 connected to the upper end of the lock surface 36. The inclined surface 38 gets farther from the surface of the bottom plate 21 at a position farther from the opening 23. The inclined surfaces 38 are utilized when the supply connector 24 is set within the main body enclosure 12 as described later in detail. The rib 35 may be formed integral with the bottom plate 21 of the base 12*a*.

Figure 5:
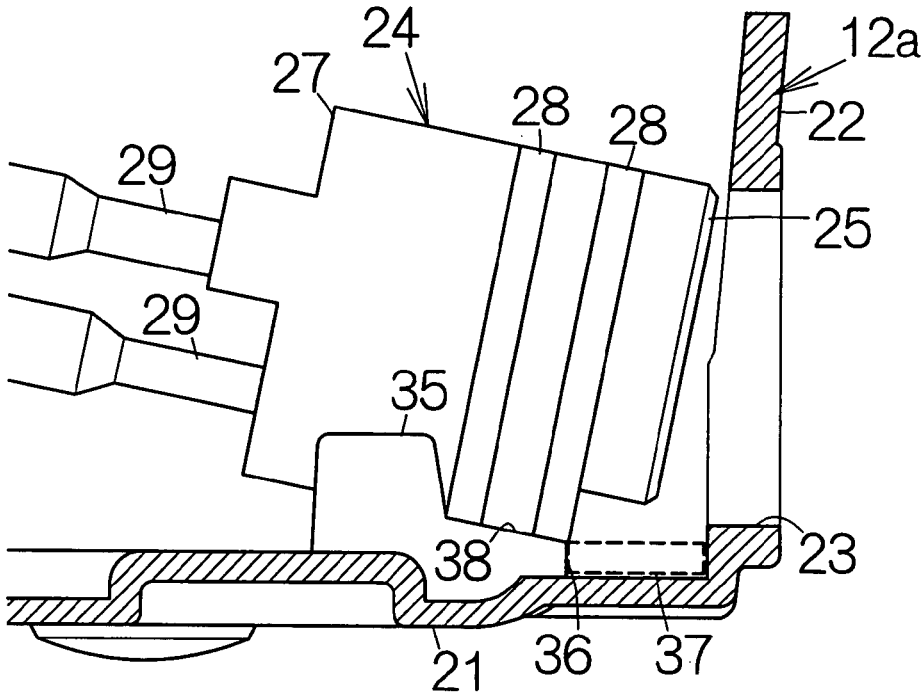
FIG. 5 is an enlarged partial sectional view, corresponding to FIG. 4, schematically illustrating the supply connector placed on inclined surfaces of the ribs in the enclosure.

Now, assume that the supply connector 24 is to be set within the main body enclosure 12. As shown in FIG. 5, the main body 27 is first received on the inclined surfaces 38 at the lower ends of the front and rear pairs of protuberances 28. The inclined surfaces 38 serve to keep the main body 27 in an inclined attitude. The front and rear pairs of the protuberances 28 are allowed to slide along the inclined surfaces 38. The main body 27 gets closer to the bottom plate 21 at a position closer to the opening 23. The cylindrical portion 25 is in this manner inserted into the opening 23. The outer periphery of the cylindrical portion 25 is kept in contact with the edge of the opening 23 during the insertion.

Figure 6:
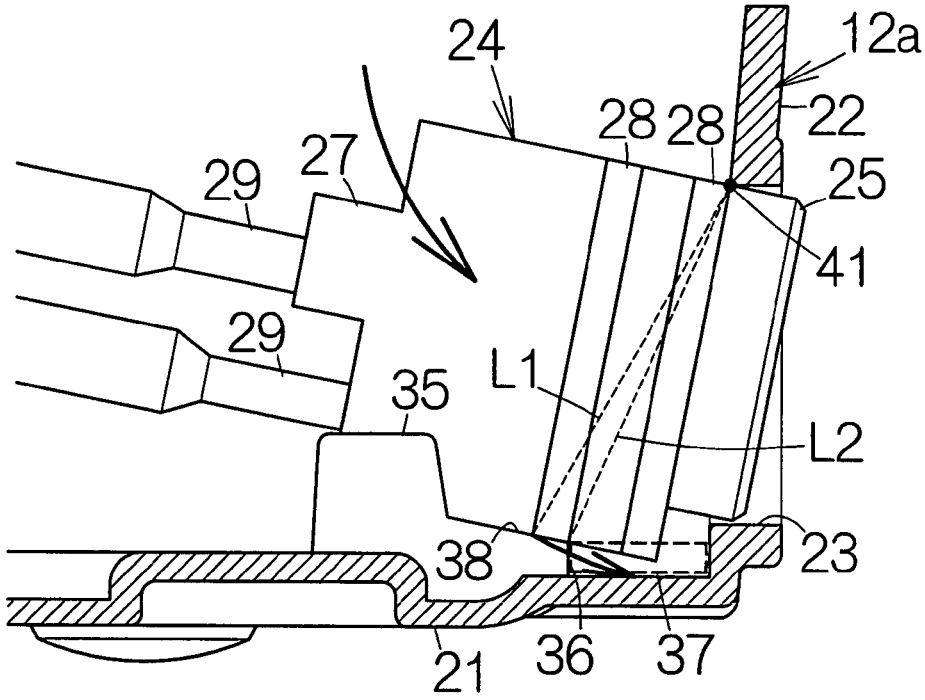
FIG. 6 is an enlarged partial sectional view, corresponding to FIG. 4, schematically illustrating the supply connector rotating around contact edges of the main body of the supply connector.

When the front end of the front protuberances 28 are received on the wall 22 around the opening 23 as shown in FIG. 6, the main body 27 stops moving. The rear protuberances 28 reach the front ends of the corresponding inclined surfaces 38. When torque is applied to the main body 27 around a contact edge 41 of the front protuberances 28 against the wall 22, the main body 27 is allowed to rotate around the contact edge 41. The rear protuberances 28 elastically deform. The rear lower edges of the rear protuberances 28 are allowed to drop off the corresponding inclined surfaces 38 into the corresponding rectangular parallelepiped spaces 37.

Figure 7:
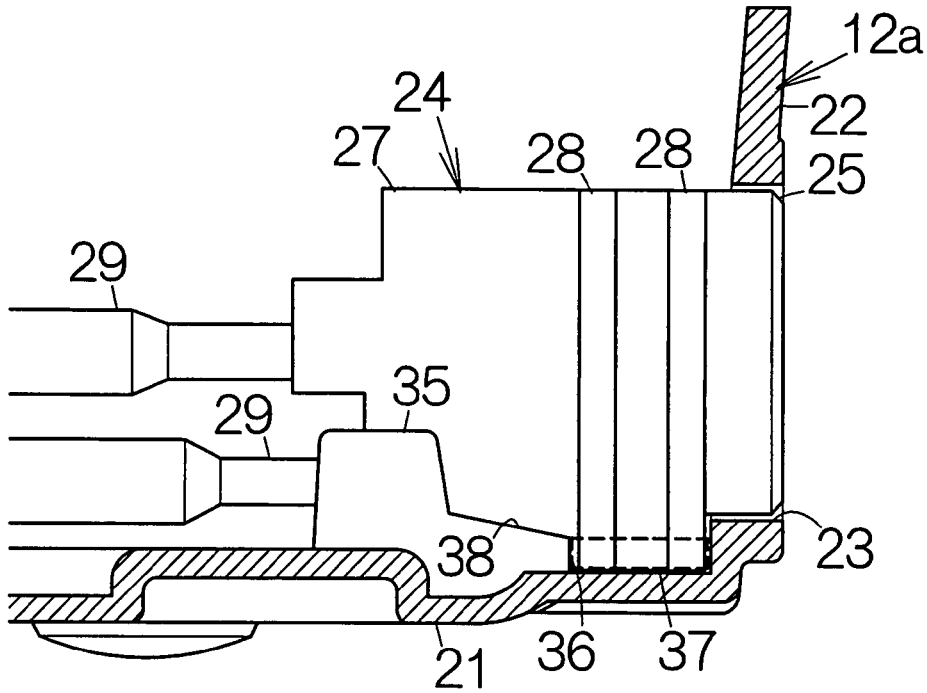
FIG. 7 is an enlarged partial sectional view, corresponding to FIG. 4, schematically illustrating the supply connector fitted between the ribs and the wall of the enclosure.

Here, the distance L1 between the contact edge 41 and the rear lower edges of the rear protuberances 28 is set larger than the distance L2 between the contact edge 41 and the front ends of the inclined surfaces 38. The distance L1 larger than the distance L2 forces the ribs 35 to contact with the rear protuberances 28 so as to interfere with the rotating movement of the main body 27. As shown in FIG. 7, the front and rear protuberances 28, 28 are then fitted between the corresponding lock surface 36 and the wall 22 after the interference. The cylindrical portion 25 is simultaneously fully received in the opening 23. The supply connector 24 is thus reliably prevented from getting disengaged from the base 12*a*. The male connector 31 is then connected to the female connector 33 on the printed circuit board 32.

The cover 12*b* is coupled to the base 12*a* in the process of assembling the main body enclosure 12. The front and rear pairs of protuberances 28 of the supply connector 24 are fitted between the corresponding lock surfaces 36 and the wall 22. The supply connector 24 can thus be held on the base 12*a* regardless of elasticity of the wirings 29. A worker is released from the care of the supply connector 24 while the cover 12*b* is coupled to the base 12*a*. The assembling operation is thus simplified.

The supply connector 24 may be utilized in electronic apparatuses such as a personal digital assistant (PDA), a cellular phone terminal and a display apparatus, in place of the notebook personal computer 11.

What is claimed is:

1. An electronic apparatus comprising:

an enclosure defining a wall standing upright from a surface of a bottom plate in a vertical direction;

an opening defined in the wall;

a connector defining a cylindrical portion located in the opening to receive a plug; and a rib standing upright from the surface of the bottom plate, the rib defining a lock surface and an inclined surface, the lock surface extending in the vertical direction so as to hold the connector between the wall and the lock surface itself, the inclined surface being connected to the upper end of the lock surface, the inclined surface getting farther from the surface of the bottom plate at a position farther from the opening.

2. A method of making an electronic apparatus, comprising:

sliding a connector along an inclined surface defined on a rib distanced from a wall standing upright from a bottom plate in a vertical direction, the inclined surface getting closer to the bottom plate at a position closer to the wall;

inserting a cylindrical portion of the connector into an opening defined in the wall through sliding movement of the connector along the inclined surface; and getting the connector off the inclined surface toward the bottom plate after insertion of the cylindrical portion so that the connector is interposed between the wall and a lock surface connected to a front end of the inclined surface, the lock surface extending in the vertical direction at a position distanced from the wall.

* * * * *